United States Patent [19]

Stoll et al.

[11] Patent Number: 4,658,603

[45] Date of Patent: Apr. 21, 1987

[54] DEVICE FOR SETTING THE ADJUSTABLE TRAVERSE OF THE YARN FEEDERS OF A FLAT KNITTING MACHINE

[76] Inventors: Thomas Stoll, Memminger Strasse 7; Ernst Goller, Hindenburgstrasse 37, both of D-7410 Reutlingen 1; Guenther Kazmaier, Fichtenstrasse 12, D-7411 St. Johann-Ohnastetten; Franz Schmid, Eichenweg 20, D-7454 Bodelshausen, all of Fed. Rep. of Germany

[21] Appl. No.: 895,449

[22] Filed: Aug. 11, 1986

[30] Foreign Application Priority Data

Aug. 19, 1985 [DE] Fed. Rep. of Germany ..... 3529610
Mar. 3, 1986 [DE] Fed. Rep. of Germany ..... 3606821

[51] Int. Cl.[4] ..... D04B 15/52
[52] U.S. Cl. ..... 66/126 R
[58] Field of Search ..... 66/126, 127, 128, 129, 66/131, 70, 73, 76

[56] References Cited

U.S. PATENT DOCUMENTS

| | | | |
|---|---|---|---|
| 2,586,205 | 2/1952 | Cobert | 66/126 R |
| 3,053,065 | 9/1962 | Steiger | 66/126 R |
| 3,364,703 | 1/1968 | Krause | 66/126 R |

*Primary Examiner*—Ronald Feldbaum
*Attorney, Agent, or Firm*—Larson and Taylor

[57] ABSTRACT

In a device for setting the adjustable traverse of a plurality of yarn feeders of a flat knitting machine, the yarn feeder limit stops (19) associated with each yarn feeder slide (15) are preferably formed as signal generators and are arranged to be longitudinally slidable on separate guide tracks of the yarn feeder rails (10–13) so that the yarn feeder slides (15) can overlap the associated yarn feeder limit stops (19). The yarn feeder limit stops (19) effect a switching procedure for the coupling devices (28) located on the cam carriage (14) which effect the movement of the yarn feeder slides (15).

10 Claims, 13 Drawing Figures

Fig.4
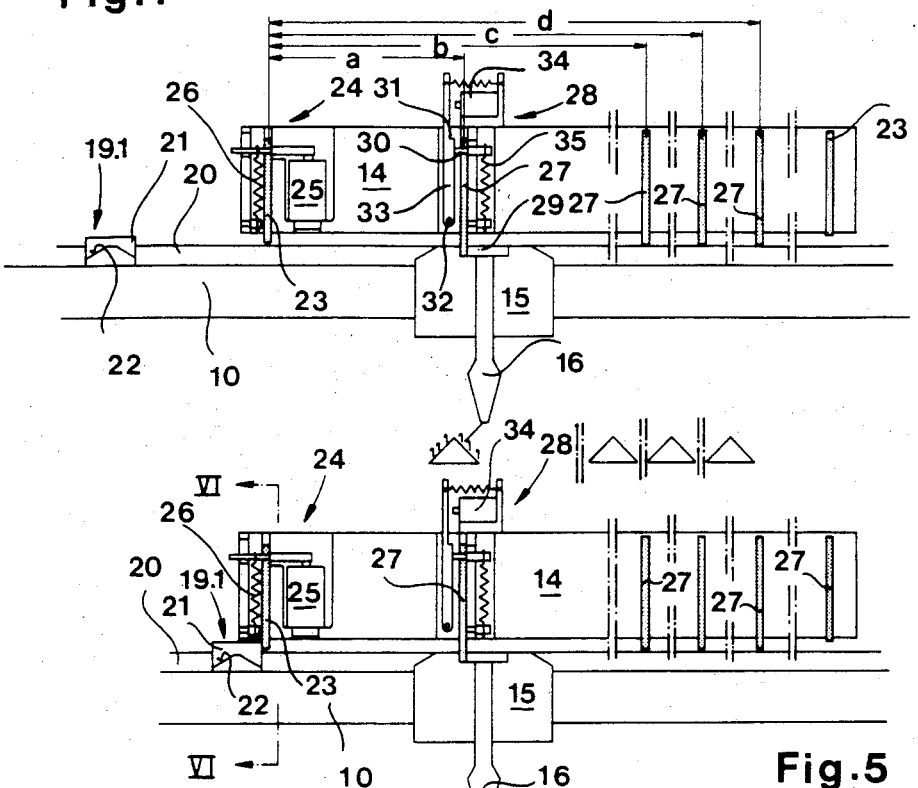
Fig.5
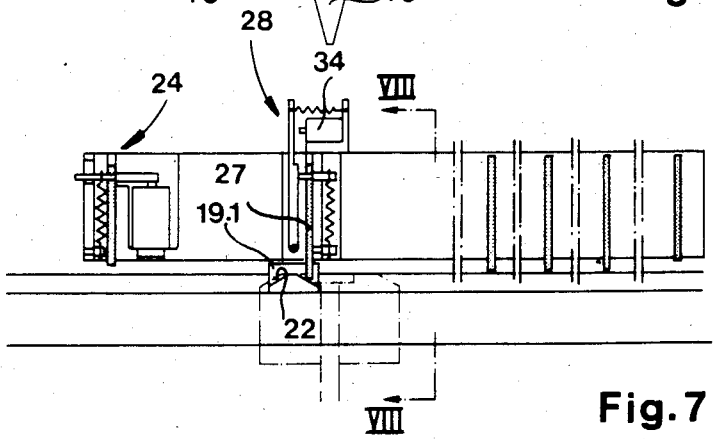
Fig.7

Fig. 10
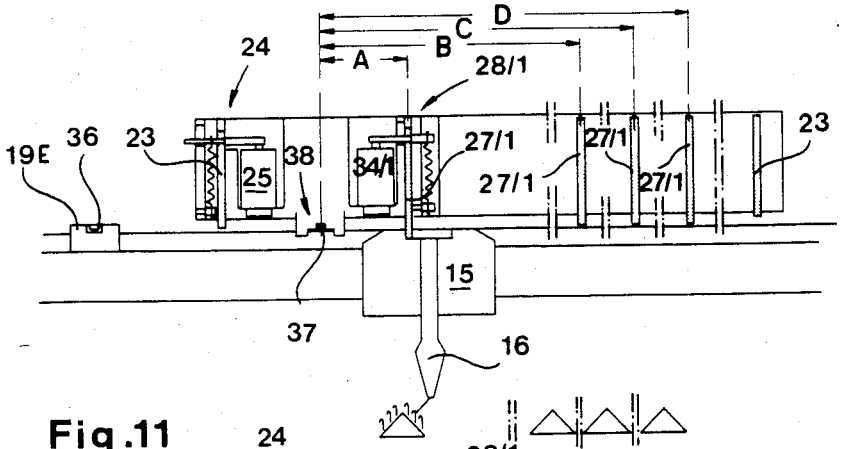
Fig.11
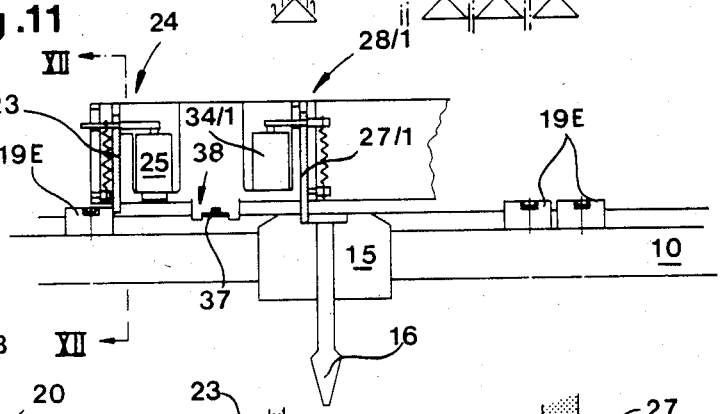
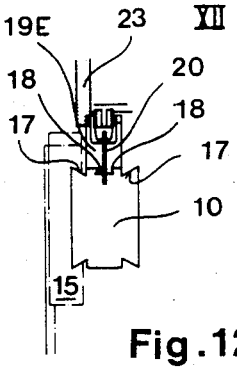
Fig.12
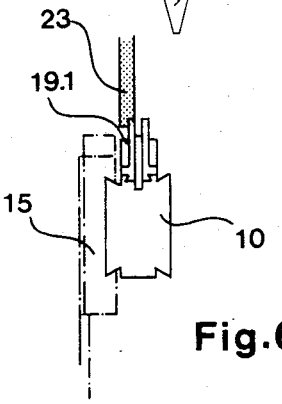
Fig.6
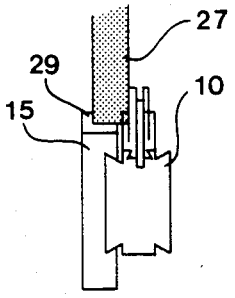
Fig.8

DEVICE FOR SETTING THE ADJUSTABLE TRAVERSE OF THE YARN FEEDERS OF A FLAT KNITTING MACHINE

FIELD OF THE INVENTION

The invention relates to a device for setting the adjustable traverse of the plurality of yarn feeders guided on the yarn feeder rails of a flat knitting machine during reciprocation of the cam carriage, the device being of the kind having electromagnetic coupling devices located on the cam carriage of the flat knitting machine and acting on the yarn feeder slides to effect their movement, and a programmable control device, which comprises a position transmitter responsive to the position of the cam carriage in relation to the needle bed, at least one adjustable desired value transmitter and at least one desired value/actual value comparator stage.

BACKGROUND OF THE INVENTION

A device of the above kind is known, for example, from U.S. Pat. No. 3,053,065. A device is also known from West German patent specification No. 3045758 in which the yarn feeder limit stops of conventional flat knitting machines are completely eliminated and the control device acts directly and exclusively on the electromagnetic coupling devices for the yarn feeder slides. It has been shown in practice, however, that flat knitting machines in which a knitting program can only be carried out if all of the data is given in a control program and alterations can only be made by altering the program, are disliked by the knitters. The knitter likes to be able to oversee the knitting production visually and therefore, there have been attempts in electronically controlled flat knitting machines to make the running of the program visually obvious and controllable by a series of display devices. There have also been attempts to give the knitter the possibility of inserting program alterations by means of a keyboard during knitting production. However, this is made difficult in that the amending instructions must have reference to a predetermined code.

SUMMARY OF THE INVENTION

In pursuit of the attempts to make modern and electronically controlled flat knitting machines user friendly, it is the object of the present invention to make the device for setting the adjustable traverse of the yarn feeders of the kind set out in the introduction such that an operator can continuously, visually observe the yarn feeder traverse adjustment and, if desired, can effect an alteration in the traverse setting by direct manual intervention without having to alter the control program of the flat knitting machine.

The object set forth is achieved according to the invention in a device of the kind set out in the introduction in that the device has at least two yarn feeder limit stops for each yarn feeder rail, which are adjustable along the yarn feeder rail, and which co-operate with at least one sensor associated with the control device and located on the cam carriage of the machine, and in that the control device has a computing stage responsive to the position of the yarn feeder limit stops as a reference value.

In a preferred embodiment of the device constructed according to the invention, the yarn feeder limit stops no longer constitute mechanical abutments for the yarn feeder slides. They do, however, allow an operator visual observation of the controlled knitting process which is especially advantageous when knitting to shape with continuous alteration of the adjustable traverse of the yarn feeders when narrowing and widening. The narrowing steps can thus be counted from the position of the yarn feeder limit stops. The yarn feeder limit stops of the device constructed according to the invention can, with this end in view, thus be part of a contact-free switching device and can carry a transmitter which influences the associated sensor of the control device located on the cam carriage of the machine and triggers the operation of an electromagnetic coupling device for the at least one yarn feeder slide. The yarn feeder limit stops thus constitute signal locations as a basis for computing operations in the control device. The yarn feeder limit stops can in each case be manually adjusted by the operator, whereby the course of a predetermined program can be altered without the program itself being interfered with or requiring a corresponding adjustment. The switching arrangement of the control device itself becomes simpler by retention of the yarn feeder limit stops which is of benefit for the reliability of the control device.

The device can be so constructed that the yarn feeder limit stops are mechanically adjustable and can be engaged by separate electromagnetically operable coupling elements located at the ends of the cam carriage, so that the yarn feeder limit stops are movable with the cam carriage into a new desired position. Additionally, the yarn feeder limit stops need not be exclusively electrical signal transmitters but can also have, for example, a cam surface for a mechanical coupling member of the coupling device of an associated yarn feeder slide, and the coupling member can suitably be mechanically secured and electromagnetically freed in its disengaged position.

Advantageously, in a device constructed in accordance with the invention, the yarn feeder limit stops, in contrast to the hitherto usual limit stops, can be arranged so that they are displaced out of the plane of the yarn feeder slides and are thus movable to positions which exactly correspond to the desired end positions of the yarn feeders. With such an embodiment there is the advantage that the control device need only provide an exact control position for the coupling members for the yarn feeder limit stops, whilst, in the coupling devices for the yarn feeder slides, it is sufficient to provide simple release magnets for the control of which large tolerances are permissible. For example, in the case of such an embodiment the coupling devices can be released during a reversal of the traverse of the cam carriage.

The guide track for the yarn feeder limit stops can advantageously be formed on the yarn feeder rail opposite the guide track for the, generally, substantially bigger yarn feeder slide but parallel to and displaced therefrom.

The operating reliability of the switching device can be improved and also, in the case of very long flat knitting machines with correspondingly long yarn feeder rails, can be ensured by providing the yarn feeder rails with an upwardly extending supporting plate, which engages in a guide slot of the cam carriage and, during the switching and coupling procedures, supports the yarn feeder rails, with the yarn feeder limit stops located on them for longitudinal movement, against distorting forces.

BRIEF DESCRIPTION OF THE DRAWINGS

In the following, embodiments of the device constructed in accordance with the invention will be explained in greater detail by way of example with reference to the accompanying drawings.

In the drawings

FIG. 4 is a schematic side view of the cam carriage of a flat knitting machine with a coupling device for the yarn feeder limit stop of a device according to FIG. 3 and with a coupling device for an associated yarn feeder siide including the coupling members for further yarn feeder slides;

FIG. 5 is a view corresponding to FIGS. 1 and 3 with a device having coupling devices acting on the yarn feeder limit stops;

FIG. 6 is a cross-sectional view on line VI—VI in FIG. 5;

FIG. 7 is a side view corresponding to FIG. 4 at the moment of operation of the coupling device for the yarn feeder slide by the yarn feeder limit stop in the embodiment of FIG. 3;

FIG. 8 is a cross-sectional view on line VIII—VIII in FIG. 7;

FIG. 10 is a side view corresponding to FIG. 4 with a coupling device for a yarn feeder limit stop, an associated switching device and the associated coupling device for the yarn feeder slide;

FIG. 11 is a side view corresponding to FIG. 10 showing the adjustment of the yarn feeder slide;

FIG. 12 is a cross-sectional view through the device along the line XII—XII in FIG. 11.

DETAILED DESCRIPTION OF THE PREFERRED EMBODIMENTS

Figure 1:
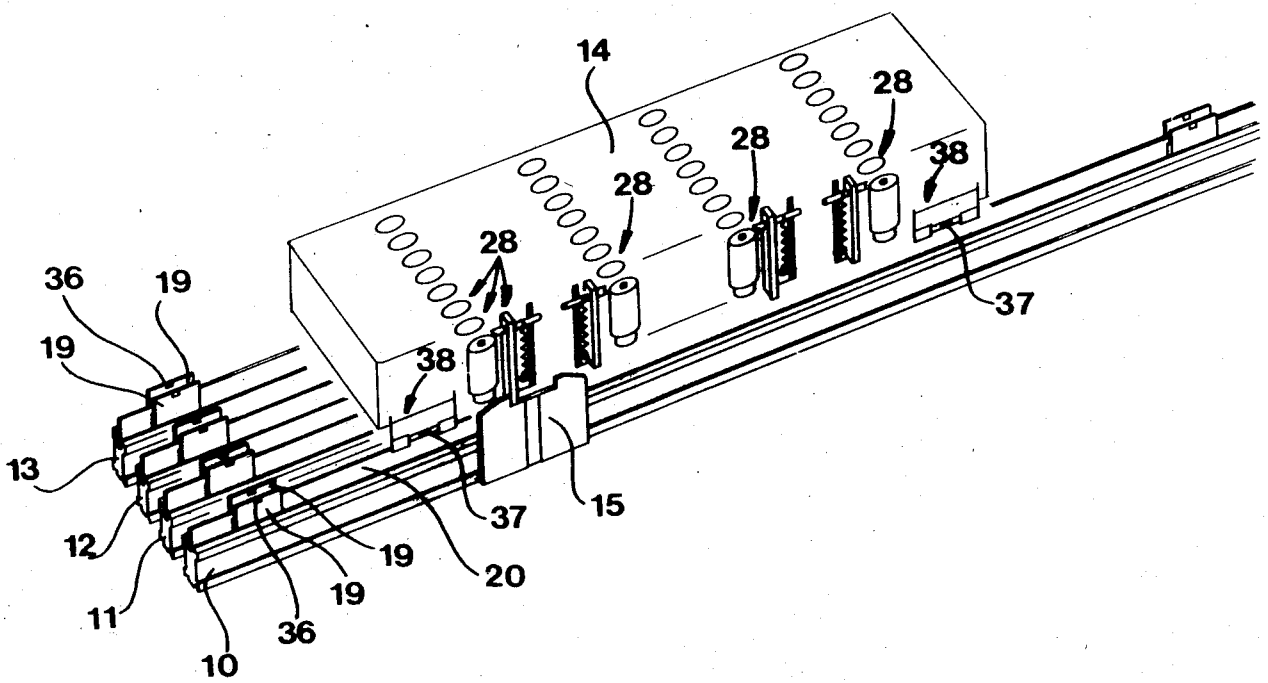
FIG. 1 is a very schematic perspective view of yarn feeder limit stops located on four yarn feeder rails and a part of the cam carriage of a flat knitting machine with the sensing and coupling devices located thereon.

The Figures are limited to the parts of a flat knitting machine essential to the invention. A complete view of the machine is not given. FIG. 1 shows only a section of the machine comprising four symmetrically formed double yarn feeder rails 10, 11, 12 and 13 extending parallel to one another in known manner, and a part 14 of the cam carriage of the flat knitting machine located above them, which carries the coupling devices shown individually in greater detail. On each double yarn feeder rail 10–13 there is mounted, in known manner, that is on both sides, a yarn feeder slide 15 together with the actual yarn feeder 16 (FIGS. 4, 5) on an outer dovetailed shaped guide track 17, best seen in the sectional drawing of FIG. 12. Near the outer guide tracks 17 and extending parallel thereto towards the center of the machine, and thus extending inwardly on the upper side of the yarn feeder rails 10–13, is in each case a guide track 18, also visible in and shown in FIG. 12, for the yarn feeder limit stop 19, associated with an individual yarn feeder slide 15, which can take various forms. The double yarn feeder rails 10 have on their upper side in their central plane a central supporting plate 20, which is engaged in a guide slot of the cam carriage of the flat knitting machine, not shown in the drawings, and which stabilizes the yarn feeder rails 10–13.

In the embodiment shown in FIG. 1, the yarn feeder limit stops 19 are formed so as to be manually adjustable and each has a permanent magnet 36 as a transmitter for a contact-free switching device 38, which is provided with a Hall-effect switch 37. For each yarn feeder track of the double yarn feeder rails 10–13 there is mounted on the cam carriage part 14, at both ends of the cam carriage, a switching device 38 of the control part of the device, which is provided with a Hall-effect switch 37.

Electromagnetically disengageable coupling devices 28 are provided on the cam carriage part 14 for each yarn feeder track of the double yarn feeder rails. It is assumed here that the cam carriage has four knitting systems arranged one behind the other and operative in both directions of movement of the cam carriage. Accordingly, four coupling devices 28 are also provided for each yarn feeder rail 10–13, all four of which can be operative in one direction of movement of the cam carriage. The construction of the coupling devices 28 will be explained in greater detail below.

Figure 2:
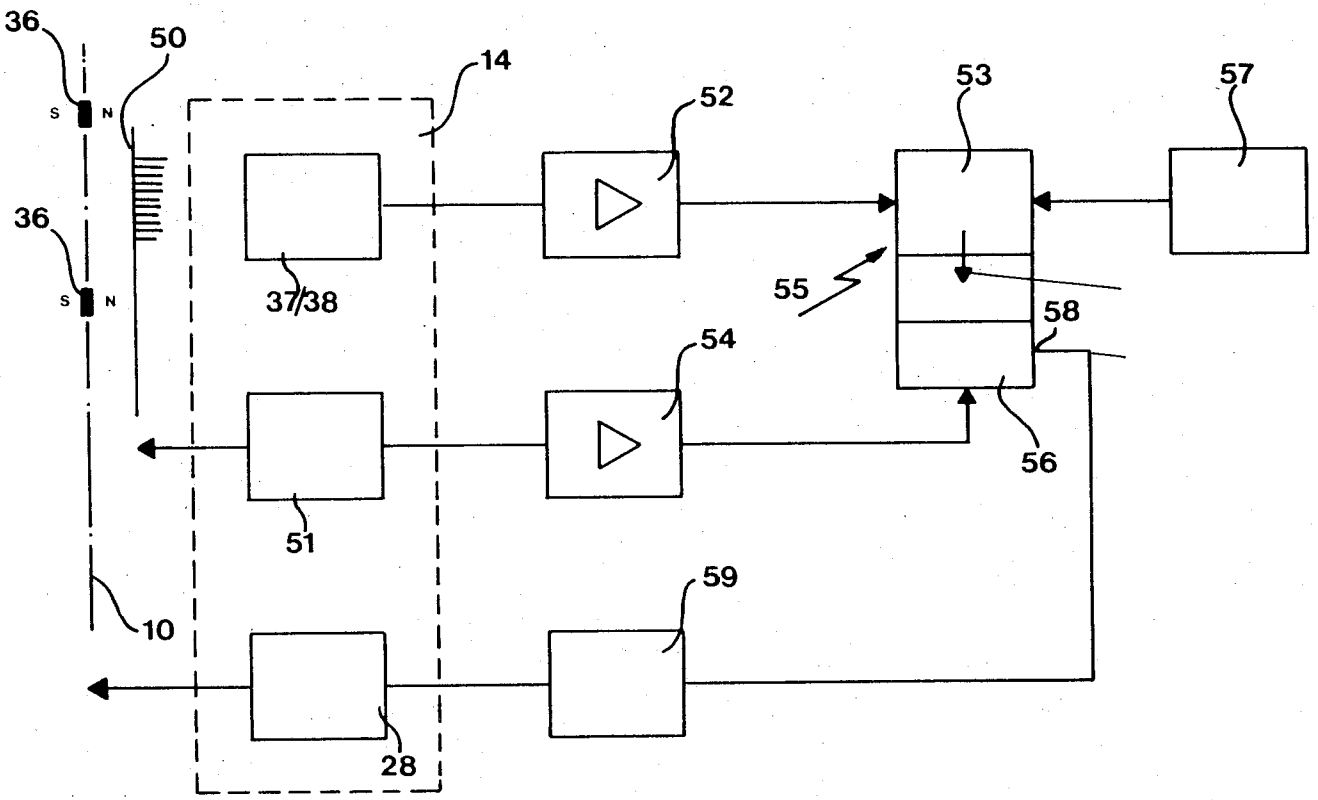
FIG. 2 is a block diagram of the control device which effects adjustment of the yarn feeders in dependence upon the position of the yarn feeder limit stops.

FIG. 2 shows the control part of the device, in which the permanent magnets 36 of the yarn feeder limit stops 19 act on the contact-free switching device 37,38. A guide track of the yarn feeder rail 10 is shown by a chain-dotted line in FIG. 2. The needle bed 50 over which the cam carriage of the machine slides is also shown. On the cam carriage of the machine is shown, in addition to a contact-free switching device 37,38, a position sensor 51, which senses the needle bed 50 and, in known manner, produces a pulse as it passes each needle trick of the needle bed 50, as well as one of the electromagnetic coupling devices 28 for the yarn feeders. Each of the switching devices 37,38 is connected through an amplifier 52 with a computing stage 53 of a microprocessor 55. The position sensor 51 is connected through an amplifier 54 with a comparator stage 56 of the microprocessor 55. The control device also includes a program memory 57 which supplies relative desired values to the computing stage 53 of the microprocessor 55. Absolute desired values reach the comparator stage 56 of the microprocessor from the computing stage 53 and an output 58 of the microprocessor 55 is connected to the electromagnetic coupling device 28 of the cam carriage 14 through an output stage 59. The signals released to the switching device 37,38 by the yarn feeder limit stops 36 constitute reference values for the computing stage 53 of the microprocessors.

The yarn feeder limit stops 19 can, however, also be mechanically adjustable and act as mechanical switching devices. An embodiment with mechanically acting yarn feeder limit stops 19.1 is shown in FIGS. 3 to 8. They have, extending in the direction in which they are longitudinally displaceable, and adjacent one another, an abutment plate 21 (FIGS. 4, 5), which extends higher, and a lower lying cam surface 22 (FIGS. 4, 5) effective in both directions of movement of the cam carriage 14. The abutment plate 21 of each yarn feeder limit stop 19.1 of the device co-operates with a coupling member 23 of the coupling device 24, which is located at one end or the other of the cam carriage part 14, and has an accurately located switchable electromagnet 25, by means of which the coupling member 23 is upwardly movable against the action of a return spring 26 shown in FIGS. 4 and 5 and can thereby be brought out of engagement with the abutment plate 21 of the yarn feeder limit stop 19.1. The cam surface 22 on the other hand acts on the coupling plates 27 of the electromagnetically disengageable coupling devices 28 for the yarn feeder slides 15. The coupling devices 28 are provided in the region of each knitting system of the cam carriage, in each case as a pair for each yarn feeder rail 10–13. The coupling plates 27 of all four coupling devices 28 associated with the yarn feeder rails 10–13 are illustrated in FIG. 4. The predetermined spacings of the coupling plates 27 of the coupling devices 28, which act on the yarn feeder slides 15, from the coupling member 23 of the coupling device 24, which acts on the associated yarn feeder limit stop 19.1, are indicated by a, b, c, and d.

One of the coupling devices 28 is shown in greater detail in FIGS. 4, 5 and 7. The coupling plate 27 is provided with a stop pin 30 and the end of the coupling plate 27 extends into an upper recess 29 in the yarn feeder slide 15. If the coupling end of the coupling plate 27, which, as seen in FIG. 8, extends sideways out of the recess 29 of the yarn feeder slide 15, slides over the raised surface 22 of one of the yarn feeder limit stops 19.1, the coupling member 27 is lifted up until the stop pin 30 engages over a shoulder 31 of a pivoted lever 33 movable about an axis 32. The pivoted lever 33 constitutes the detent of one of the electromagnets 24 operated by the control device, which is not shown, with whose help, the stop pin 30, upon movement of the pivoted lever 33 in the anti-clockwise direction, can be released so that the coupling plate 27 under the influence of a return spring 35 takes up its coupling position which is shown in FIGS. 4, 5 and 7.

FIGS. 5 and 6 show the coupling member 23 of a coupling device 24 for moving a yarn feeder slide 19.1 in position opposite its abutment plate 21. FIGS. 7 and 8 show the coupling plate 27 of the a coupling device 28 sliding over the cam surface 22 of a yarn feeder limit stop 19. Control of the coupling devices 24 and thus the positioning of the yarn feeder limit stops 19 as well as the energization of the coupling devices 28 for the yarn feeder slides 15 is effected according to a predetermined knitting program, which is fed into the memory 57 of the control device of FIG. 2. De-energization of the coupling devices 28 is, on the contrary, effected mechanically as their coupling plates 27 slide over the cam surface 22 of the associated yarn feeder limit stops.

Figure 3:
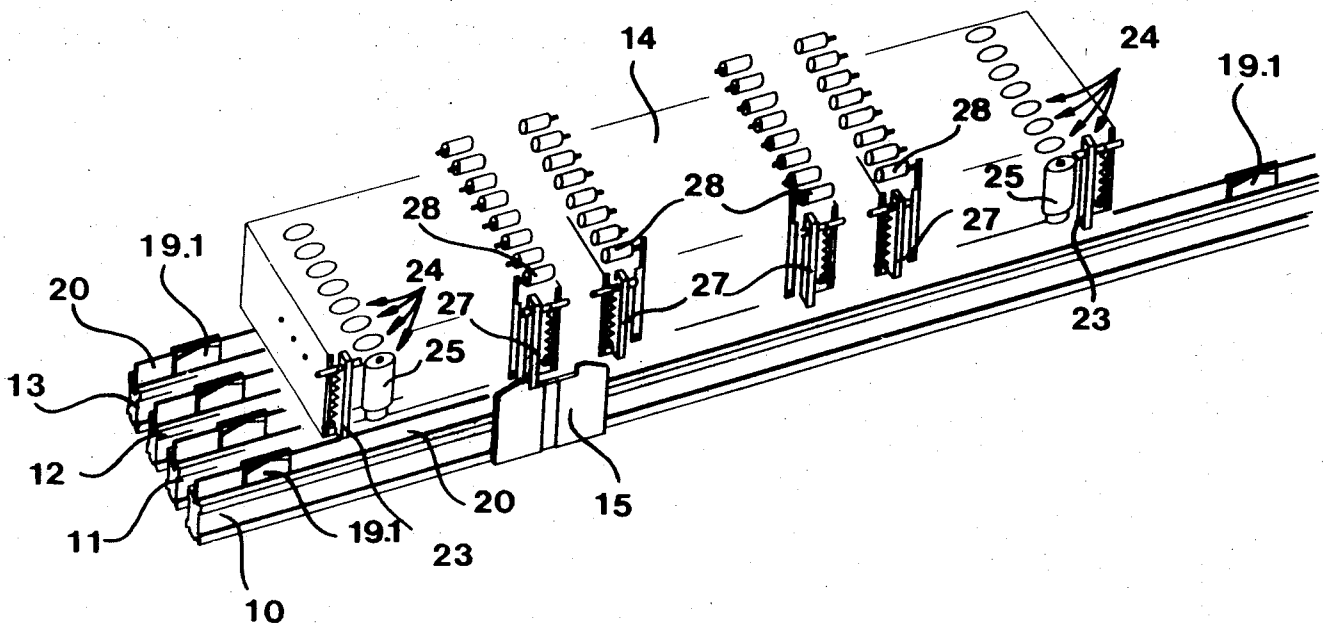
FIG. 3 is a view corresponding to FIG. 1 of a device with mechanically operating yarn feeder limit stops.
Figure 9:
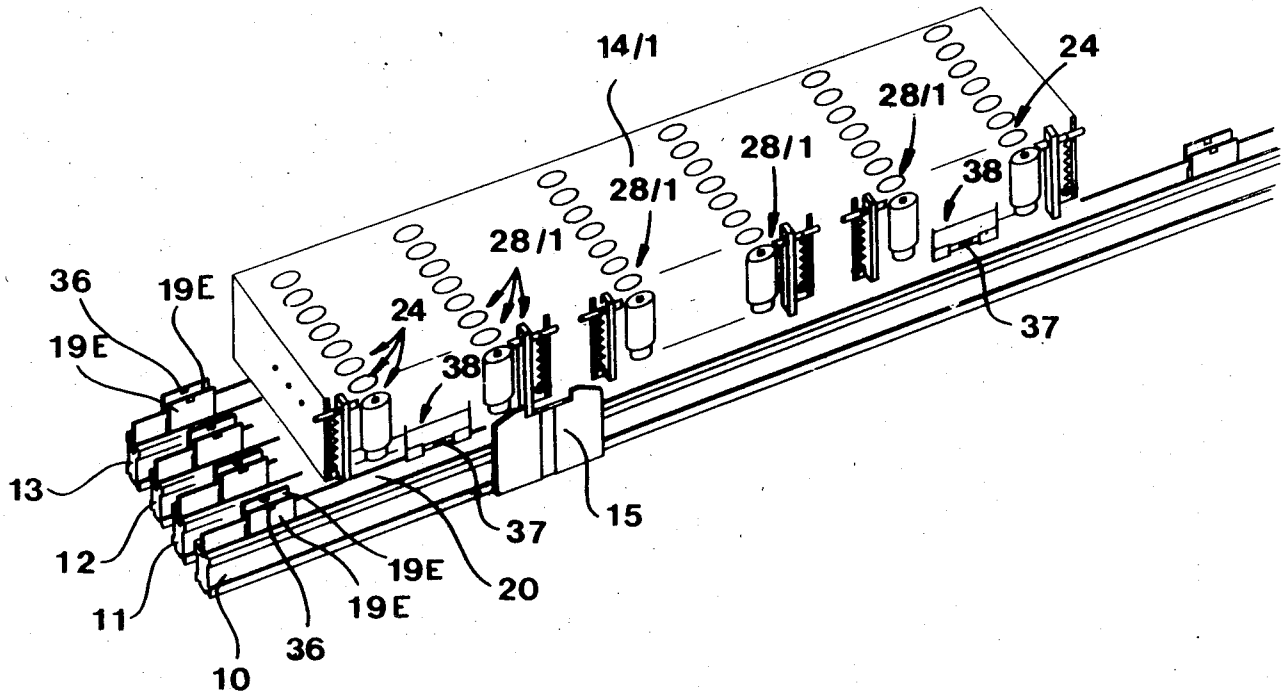
FIG. 9 is a schematic perspective view corresponding to FIG. 1 with contact-free yarn feeder limit stops, which are mechanically adjustable.

FIGS. 9 to 12 show an embodiment also with yarn feeder limit stops, 19E, associated with each yarn feeder track 17 of each yarn feeder rail 10–13 and which, like the yarn feeder limit stops 19 of the first embodiment according to FIG. 1, are longitudinally movable on separate guide tracks 18. Additionally, mechanical adjustment of the yarn feeder limit stops 19E corresponding to that in the embodiment of FIG. 3 is provided. The yarn feeder limit stops 19E, as in the embodiment of FIG. 1, are provided with a permanent magnet 36 as a transmitter for a contact free switching device 38, which co-operates with a Hall-effect switch 37 of the switching device 38 located on the cam carriage part 14/1. Positioning of the yarn feeder limit stops 19E is again achieved by means of coupling devices 24 located on the cam carriage part 14/1, formed exactly like the coupling devices 24 of the embodiment of FIG. 3. The coupling devices 28/1 for the movement of the yarn feeder slides 15 in this embodiment are formed in the same way as the coupling devices 24 for the yarn feeder limit stops 19E. Their electromagnets 34/1 are operated by the Hall-effect switches 37 of the switching devices 38, when they pass the permanent magnets 36 of the associated yarn feeder stops 19E. The spacing of the coupling plates 27/1 of the individual coupling devices 28/1 of an associated switching device 38 are fixed and are indicated in FIG. 10 by the letters A, B, C and D. On the basis of these fixed spacings A–D, energization of the electromagnets 34/1 of the coupling devices 28/1 can be effected in the control section of the control device in dependence upon the speed of the cam carriage by actuation of a Hall-effect switch 37.

Figure 13:
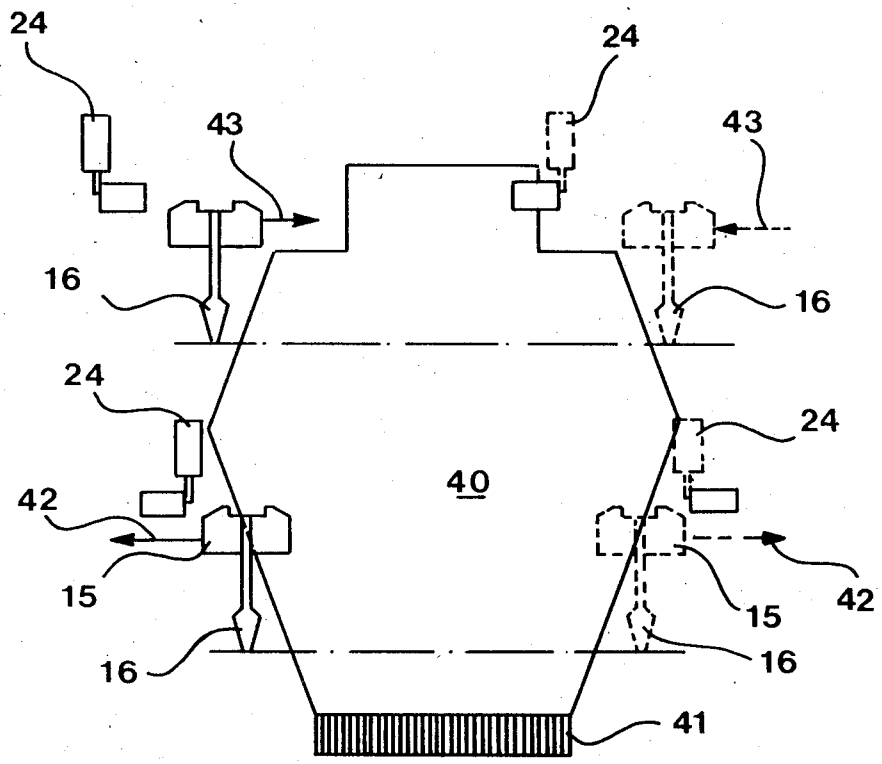
FIG. 13 schematically illustrates the adjustment of the yarn feeders in the production of a shaped piece of knitting on a flat knitting machine.

FIG. 13 shows a shaped piece of knitting 40, the lower part of which, starting at a waistband 41, is produced by widening. In the widening region, the yarn feeders 16 can, by means of the devices described above, be moved outwards successively in the direction of the indicated arrows 42 by the preceding coupling devices 24 for the next widening in accordance with the pattern. In an embodiment according to FIG. 1, however, the yarn feeder limit stops 19 can also be maintained in a predetermined position and the widening steps can be computed from a fixed reference point established by the yarn feeder limit stops. In the adjoining upper region of FIG. 13 the shaped piece of knitting 40 is produced by narrowing and the narrowing steps can again either be computed, or the yarn feeders 16 can be moved back successively and inwardly in the direction of the indicated arrows 43 by a trailing coupling device 24.

We claim:

1. A device for use in a flat knitting machine having a needle bed, a cam carriage, a plurality of yarn feeders, and yarn feeder rails guiding said feeders during reciprocation of the cam carriage, said device comprising electromagnetic coupling devices located on the cam carriage of the flat knitting machine and acting upon the yarn feeders to effect their movement, a programmable control device comprising a position transmitter responsive to the position of the cam carriage in relation to the needle bed, at least one desired value/actual value comparator stage, at least two yarn feeder limit stops being provided for each yarn feeder rail, which stops are adjustable along the rail, at least one sensor/coupling member being associated with the control device, said stops co-operating with said sensor/coupling member, the latter being located on said cam carriage, and said control device having a computing stage responsive to the position of the yarn feeder limit stops as a reference value.

2. A device according to claim 1, wherein the yarn feeder limit stops are infinitely adjustable manually.

3. A device according to claim 1, wherein the yarn feeder limit stops are mechanically adjustable.

4. A device according to claim 1 wherein each yarn feeder limit stop carries a transmitter of a contact-free switching device which acts on at least one receiver of the control device located on the cam carriage of the machine and associated with at least one corresponding yarn feeder slide.

5. A device according to claim 1, wherein the yarn feeder limit stops have a cam surface for a mechanical coupling plate of the coupling device of an associated yarn feeder slide, and the coupling plate in its disengaged position is mechanically securable and electromagnetically freed.

6. A device according to claim 1, wherein each yarn feeder rail is provided with an upwardly extending supporting plate engaged in a guide slot of the cam carriage of the machine.

7. A device according to claim 6, wherein the yarn feeder rails are formed as mirror image-symmetrical double rails and the supporting plate extends along their plane of symmetry.

8. A device according to claim 1, wherein there is provided, at the ends of the cam carriage of the machine, a separate electromagnetically operable coupling member for the yarn feeder limit stops of each of the yarn feeder rails, for the adjustment of the yarn feeder limit stops.

9. A device according to claim 1, wherein a separate parallel guide track is provided on the yarn feeder rail for the yarn feeder slides, the yarn feeder limit stops being located on said separate guide track, and so formed that said stops and the associated yarn feeder slides are capable of overlapping.

10. A device according to claim 1, wherein the yarn feeder rails are formed as mirror image-symmetrical double rails, a supporting plate extending along the plane of symmetry, and both guide tracks for the yarn feeder limit stops are arranged adjacent the supporting plate extending in the plane of symmetry of the double rail.

* * * * *